US005906449A

United States Patent [19]

Ostrander

[11] Patent Number: 5,906,449

[45] Date of Patent: May 25, 1999

[54] BINDER LOCKING CLIP

[75] Inventor: Jerry B. Ostrander, St. Louis, Mo.

[73] Assignee: U.S. Ring Binder Corp., New Bedford, Mass.

[21] Appl. No.: 08/910,093

[22] Filed: Aug. 12, 1997

[51] Int. Cl.[6] ..... B42D 3/10

[52] U.S. Cl. ..... 402/48; 402/46; 402/49; 402/55; 402/56

[58] Field of Search ..... 402/46, 48, 49, 402/55, 56

[56] References Cited

U.S. PATENT DOCUMENTS 5,127,755 7/1992 Bee ..... 402/48

*Primary Examiner*—Willmon Fridie, Jr.
*Assistant Examiner*—Mark T. Henderson
*Attorney, Agent, or Firm*—Polster, Lieder, Woodruff & Lucchesi, L.C.

[57] ABSTRACT

A binder locking clip (100) used with a binder metal (10) having a locking member (50) with a slot (62) formed therein. The clip has a first leg (102) and a second leg (104). The legs are spaced apart from each other and one of the legs has a detent (106) formed in it. The detent fits in the slot and engages a post (56) with respect to which the slot is movable when the locking member is moved. The clip engages the post when the frame member is moved in a direction by which the binder metal can be opened to prevent movement of the locking member in that direction.

11 Claims, 3 Drawing Sheets

BINDER LOCKING CLIP

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

This invention relates to binders employing a post and sleeve or "catalog" metal, and more particularly, to a clip for locking the metal closed during shipment or storage of the binder.

Catalog binders are binders used to hold a substantial quantity of material. Typically the binder is sized to individuals sheets of material which, for a catalog, would include pages having part numbers, part specifications, prices, etc. The binder would be kept at a counter or desk for ready reference by sales people, countermen, etc. to look up needed information for servicing a customer. Since catalogs are continually updated with new pages, the binders are provided with a metal the is referred to as a post and sleeve type metal. That is, the metal includes a hinged section having a frame with a series of spaced sleeves extending orthogonally from the frame. A second frame element has a series of spaced posts received in the sleeves. This frame element locks to one side of the metal. When the metal is unlocked, the second frame element is removed from the first. This allows catalog pages to be inserted in the binder. After insertion, the second frame element is intermitted with the first and locked in place.

It has been found that when the binders are shipped from a distribution center to satellite stores or offices, the weight of the catalog pages stored in the binder can cause the binder to come open. When this occurs, the two frame elements can separate from one another resulting in the binder's contents spilling out. The result is a mess. Pages can be lost or misfiled when everything is reassembled. It would be convenient to have a simple mechanism which would prevent this problem from occurring.

BRIEF SUMMARY OF THE INVENTION

Among the several objects of the present invention may be noted the provision of a binder locking clip usable with a catalog binder or the like;

- the provision of such a clip which is readily installed on a metal after the catalog is assembled and which, thereafter, prevents the binder from being opened until the clip is removed;
- the provision of such a clip which is easily removed when no longer needed;
- the provision of such a clip to be of a plastic or lightweight metal and is disposable;
- the provision of such a clip to be of different sizes for use with different size binders;
- the provision of such a clip having a detent which fits into a slot in the binder metal to prevent a locked frame member of the metal from inadvertently being unlocked and resulting in a spillage;
- the provision of such a clip to have a tab extending from the top of the clip to facilitate installation and removal of the clip; and,

- the provision of such a clip which is a low cost part that is inexpensive to make but which insures the integrity of the contents of a binder with which it is used during transport and storage of the binder.

In accordance with the invention, generally stated, a binder clip of the present invention is for locking a binder metal so the metal cannot inadvertently open during shipment or storage. The metal has fixed and movable frame elements and one of the movable elements is has a pin which is received in a slot of a movable locking bar of the metal. When the locking bar is in a locked position, the movable frame element is held in a fixed position. The binder clip is a generally U-shaped clip having legs spaced apart legs which allow the clip to fit over the movable frame member and locking bar. One of the legs has a detent which fits into the locking bar slot. When in place, the detent prevents movement of the locking bar so the metal is locked in its closed position and cannot be opened. When the clip is removed, the locking bar is again freely movable to release the movable frame element so the binder can be opened. Other objects and features will be in part apparent and in part pointed out hereinafter.

BRIEF DESCRIPTION OF THE DRAWINGS

In the drawings.

Corresponding reference characters indicate corresponding parts throughout the drawings.

DETAILED DESCRIPTION OF THE INVENTION

Figure 1:
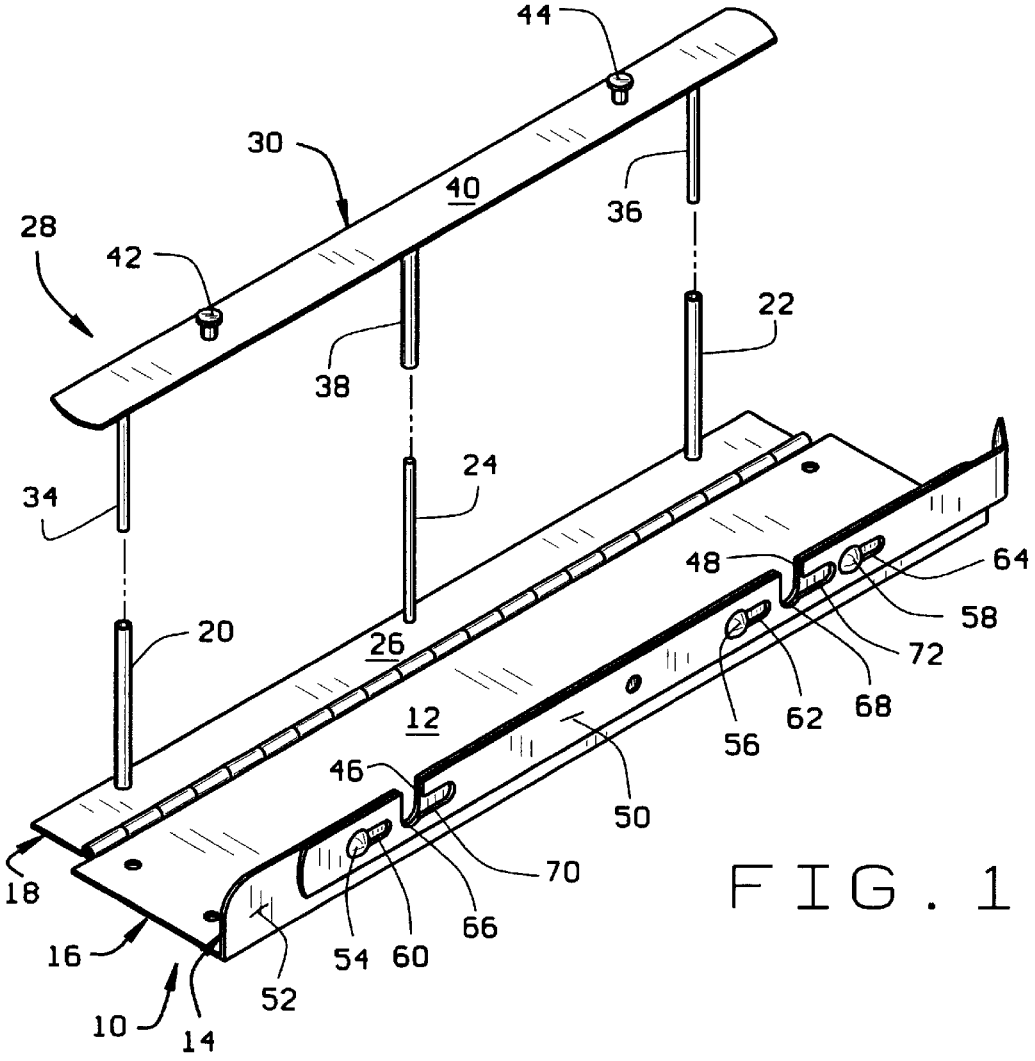
FIG. 1 is a perspective view of a post and sleeve metal used in a catalog binder.

Referring to the drawings, a catalog binder (not shown) includes a metal indicated generally 10. The metal has a base plate 12 which attaches to a spine section of the binder. The base plate is generally L-shaped having a side section 14 extending along one side of a flat base section 16 of the base plate. Side 14 extends the length of the base plate. A first movable frame member 18 is hingedly connected to base section 16 on the opposite side of the base plate. Member 18 comprises an elongate, rectangular plate extending substantially the length of the base plate. The member hingedly attaches to the base plate along one side of the member so the member can rotate away from and toward the base plate. Spaced along the length of member 18, at predetermined intervals are two sleeves 20, 22, and a post 24. The sleeves are located at each end of member 18 and the post is located in the middle of the member. Both the sleeves and the post extend outwardly from an inner face 26 of member 18 at a right angle to the face.

Figure 2:
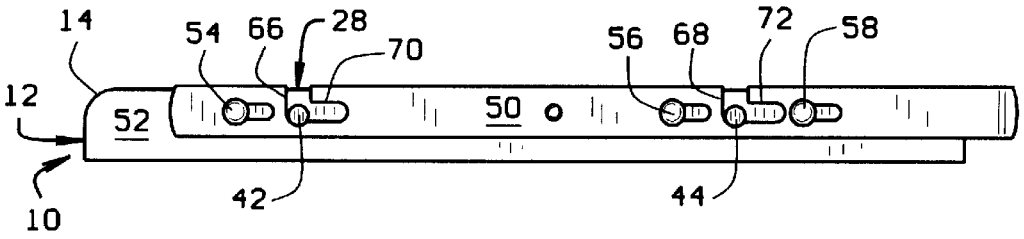
FIG. 2 is a side elevational view of the metal with a locking bar in a position at which the binder can be opened.
Figure 3:
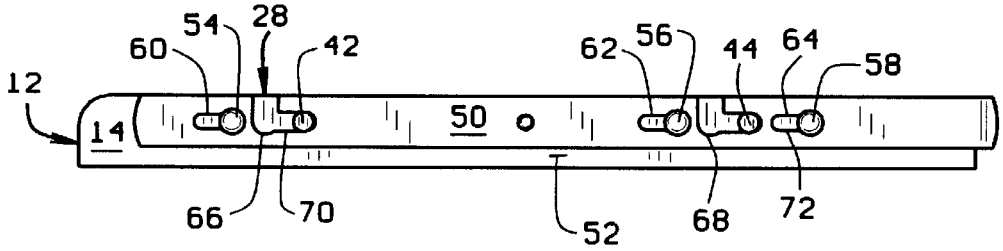
FIG. 3 is a view similar to FIG. 2 with the locking bar in its binder closing position.
Figure 4:
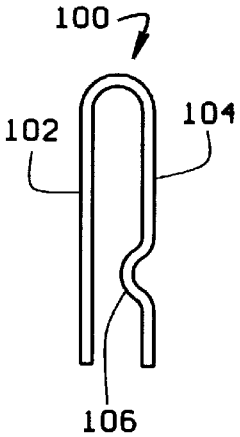
FIG. 4 is a side elevational view of a locking clip of the present invention.
Figure 5:
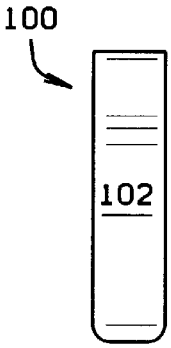
FIGS. 5–7 are respective front and rear elevational views and a bottom plan view of the clip.
Figure 6:
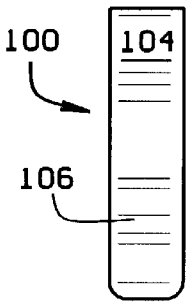
Figure 7:
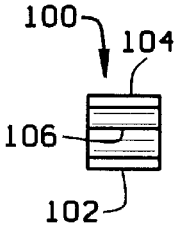

A second movable frame member 28 comprises an elongate rectangular plate 30 from one side 32 of which extend two posts 34, 36, and a sleeve 38. The posts are located at the respective ends of member 30 and the sleeve is located in the middle of the member. The posts and sleeve are sized so to interfit with sleeves and post on member 18. On the opposite side 40 of member 28 are a pair of spaced posts 42, 44 which are received in notches 46, 48 extending from a topwall of side section 14 into the body of the side section. A sliding locking member 50 is slidingly attached to an outer face 52 of side section 14. Three posts 54, 56, 58, extend outwardly from outer face 52 of the side section, and locking member 50 has elongate slots 60, 62, 64 extending longitudinally of the member in which the pins are respectively received. One of the posts 54 is located toward one end of side section 14, outwardly of the location of notch 46. The other two posts are located at the other end of the side section on either side of notch 48. Locking member 50 has a pair of notches 66, 68 formed therein, which, when the locking member is properly positioned are in registry with respective notches 46, 48. Each of the notches 66, 68, has an extension 70, 72 extending longitudinally of the locking member. When the locking member is in its position shown in FIG. 2, the posts 42, 44 of frame member 28 are freely movable into and out of notches 46, 48. However, if the locking member is moved to its position shown in FIG. 3, these posts are captured in the extensions 70, 72 of the respective notches 66, 68. The frame member 28 is now locked in place.

Figure 8:
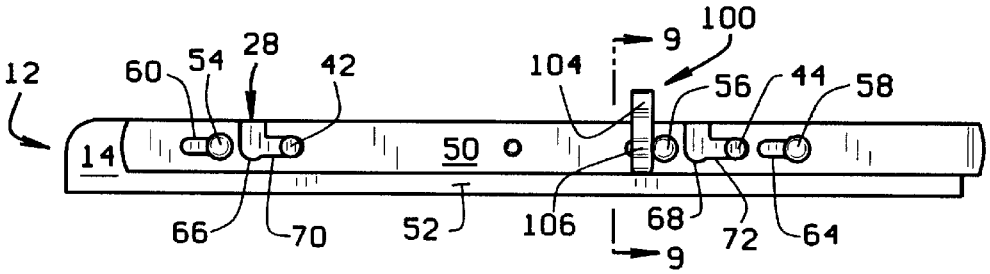
FIG. 8 is a view similar to FIG. 3 but with a binder locking clip installed.
Figure 9:
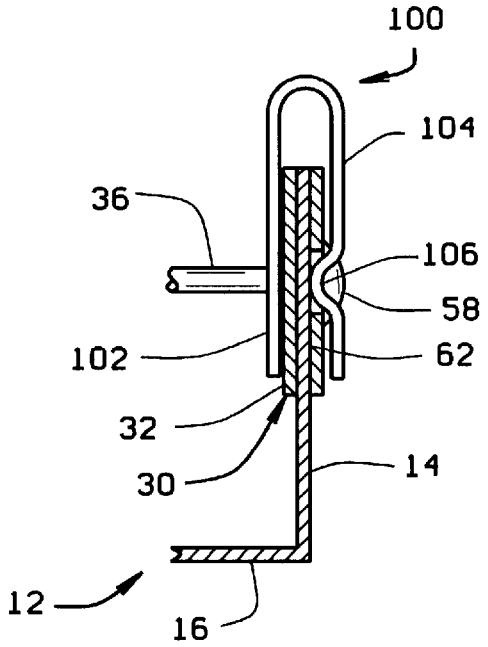
FIG. 9 is a sectional view taken along lines 9—9 in FIG. 8.

It has been found, however, that when a catalog binder filled with pages is being transported, locking member 50 can be inadvertently moved so that frame member 28 is released. Because frame member 28 is not otherwise held in place, it can separate from frame member 18 causing a spillage of paper. To present this, a binder locking clip 100 of the present invention is used to secure locking member 50 in place and prevent its movement. Clip 100 is a generally U-shaped clip having legs 102, 104. Leg 102 is a straight leg; while, leg 104 has a detent 106 formed in it. The clip is sized so, as shown in FIG. 9, the clip can be inserted over frame member 28, side section 14, and locking member 50. The length of the clip is such that leg 104 extends past the slots 60, 62, 64 formed in the locking member. The detent 106 is located along the length of the leg such that it fits in one of slots. In FIGS. 8 and 9, the detent is shown fitting in slot 62. However, the width of the clip is such that the detent will fit in any of the slots. When in place, the clip prevents movement of locking member 50. That is, when the locking member tries to move toward the right (as viewed in the drawings), which is the unlocking direction of movement, the left end of the slot in which the clip is inserted presses the clip against the respective post 54, 56, 58, blocking movement of the locking member.

Figure 10:
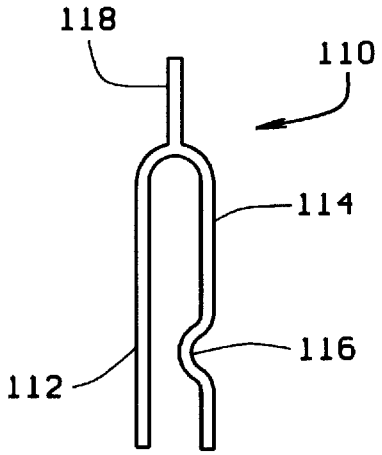
FIG. 10 is a side elevational view of a second embodiment of the clip.
Figure 11:
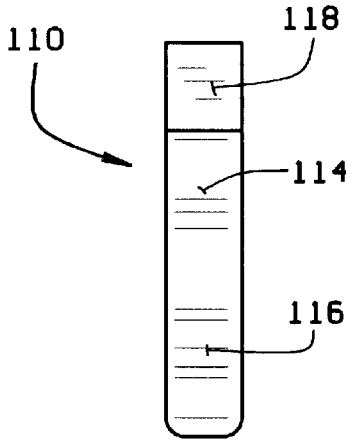
FIG. 11 is a front elevational view of the second embodiment.
Figure 12:
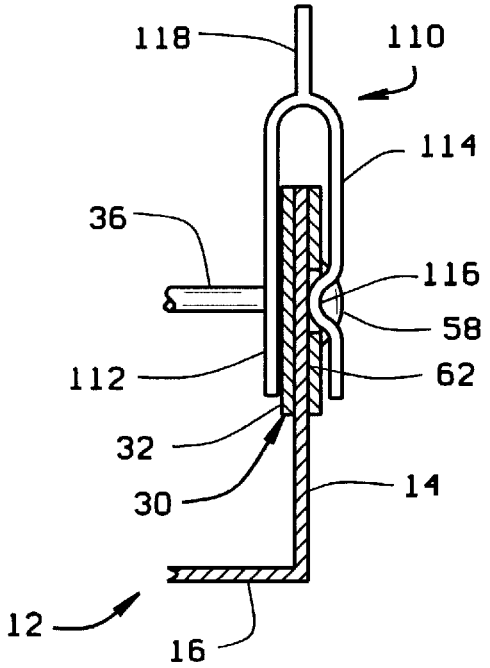
FIG. 12 is a sectional view similar to FIG. 9 but with a second embodiment binder locking clip installed.

Clip 100 is made of a plastic or lightweight spring metal. As shown in FIGS. 10–12, a second embodiment 110 of the clip can be formed with a tab 118 for installing legs 112, 114 of the clip over the respective sides of the metal for a detent 116 to be inserted in an appropriate slot. The clip is installed at location where the catalogs are put together and left in place until the catalogs are ready for use at a desired location. The clip is then removed and disposed of, although, if desired, the clip can be reused. The clip is available in more than one size for use with different size catalog binders.

What has been described is a binder locking clip usable with a catalog binders and readily installed on a metal after the catalog is assembled. The clip thereafter prevents the binder from being opened until the clip is removed. The clip has a tap for ease of installation and the clip is disposable after use. The clip is of a plastic or lightweight metal and is available in different for use with different size binders. A detent formed in one leg of the clip fits into a slot in the binder metal to prevent a locked frame member of the metal from moving so the metal cannot be opened while the clip is in place.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A binder locking clip for use with a binder metal having a locking member with a slot formed therein, said clip having a first leg and a second leg, said legs being spaced apart from each other and one of said legs having a detent formed therein fitting in said slot to engage a post with respect to which said slot is movable when said locking member is moved, said clip engaging said post when said locking member is moved in a direction which enables said binder metal to be opened to prevent movement of said locking member in that direction.

2. The clip of claim 1 which is a U-shaped clip.

3. The clip of claim 1 which is made of a plastic material.

4. The clip of claim 1 which is made of a spring metal.

5. The clip of claim 2 further including a tab formed on the clip and extending outwardly from the clip to facilitate insertion of the clip into the slot and removal of the clip from the slot.

6. In a catalog binder metal having a base plate with a side section with side posts extending outwardly therefrom and notches formed therein, a movable frame member having posts received in said notches, and a locking member having longitudinally extending slots in which said side posts are received and to which said locking member is movable, said locking member having notches formed therein corresponding to said notches formed in said side section for said posts on said movable frame member to be received in said notches in said side section and said locking member whereby movement of said locking member captures said posts of said movable frame member to lock said movable frame member in a binder closed position, a binder locking clip having a first leg and a second leg, said legs being spaced apart from each other and one of said legs having a detent formed therein fitting in one of said slots to engage a side post with respect to which said slot is movable when said locking member is moved, said clip engaging said side post when said frame member is moved in a direction by which said binder metal can be opened to prevent movement of said locking member in that direction.

7. The binder locking clip of claim 6 which is a U-shaped clip.

8. The binder locking clip of claim 7 further including a tab formed on one side thereof and extending outwardly from the clip to facilitate insertion and removal of the clip from the slot.

9. The binder locking clip of claim 8 which is made of a plastic.

10. The binder locking clip of claim 8 which is made of a lightweight metal material.

11. In a binder metal having a base plate with a side section with side posts extending outwardly therefrom and notches formed therein, a movable frame member having posts received in said notches, and a locking member having longitudinally extending slots in which said side posts are received and to which said locking member is movable, said locking member having notches formed therein corresponding to said notches formed in said side section for said posts on said movable frame member to be received in said notches in said side section and said locking member whereby movement of said locking member captures said posts of said movable frame member to lock said movable frame member in a binder closed position, a U-shaped binder locking clip having a first leg and a second leg, said legs being spaced apart from each other and one of said legs having a detent formed therein fitting in one of said slots to engage a side post with respect to which said slot is movable when said locking member is moved, said clip engaging said side post when said frame member is moved in a direction by which said binder metal can be opened to prevent movement of said locking member in that direction, and a tab extending outwardly from the clip to facilitate insertion of the clip into the slot and removal of the clip from the slot.

* * * * *